United States Patent [19]

Ares et al.

[11] Patent Number: 4,711,094

[45] Date of Patent: Dec. 8, 1987

[54] REVERSE CYCLE HEAT RECLAIM COIL AND SUBCOOLING METHOD

[75] Inventors: Roland A. Ares, St. Charles County; Robert A. Jones, Franklin County; Norman E. Street, St. Charles County, all of Mo.

[73] Assignee: Hussmann Corporation, Bridgeton, Mo.

[21] Appl. No.: 929,422

[22] Filed: Nov. 12, 1986

[51] Int. Cl.[4] ..... F25D 17/08

[52] U.S. Cl. ..... 62/90; 62/196.4; 62/238.6; 62/324.1

[58] Field of Search ..... 62/90, 196.4, 238.6, 62/238.7, 324.1

[56] References Cited

U.S. PATENT DOCUMENTS

| | | | |
|---|---|---|---|
| 2,892,324 | 6/1959 | Quick | 62/90 X |
| 3,026,687 | 3/1962 | Robson | 62/90 X |
| 3,139,735 | 7/1964 | Malkoff et al. | 62/90 X |
| 3,358,469 | 12/1967 | Quick | 62/196.2 |
| 3,402,564 | 9/1968 | Nussbaum | 62/90 X |
| 3,572,052 | 3/1971 | Toth | 62/90 X |
| 3,738,117 | 6/1973 | Engel | 62/90 X |
| 4,502,292 | 3/1985 | Ares et al. | 62/238.6 |

*Primary Examiner*—William E. Tapoicai

*Attorney, Agent, or Firm*—Richard G. Heywood

[57] ABSTRACT

A reverse cycle heat reclaim coil in a refrigeration system having compressor, condenser and receiver means on the high side, including first valve means for selectively connecting the heat reclaim coil between the compressor discharge side and the condenser means to obtain heat reclamation during winter operations, and second valve means for selectively connecting the heat reclaim coil between the condenser and receiver means to obtain refrigerant subcooling during summer operations. The invention also includes the method of selectively connecting the heat reclaim coil in reverse cycle refrigerant flow in seasonal heat reclamation and subcooling modes.

21 Claims, 3 Drawing Figures

REVERSE CYCLE HEAT RECLAIM COIL AND SUBCOOLING METHOD

The invention relates generally to the commercial and industrial refrigeration art, and more particularly to reverse cycle condensers for such refrigeration systems.

BACKGROUND OF THE INVENTION

Those skilled in the refrigeration art will understand and appreciate the seasonal climatic influence on large commercial and industrial refrigeration systems of the type disclosed. The primary function of such systems is to provide efficient year-round refrigeration of the respective fixtures or units cooled by the system evaporators, and the most efficient refrigeration is obtained by delivering subcooled liquid refrigerant to the expansion valves therefor. Subcooling is inherently obtained during winter and intermediate seasons by using conventional condenser flooding and/or multi-pass condensers to control or maintain the minimum compressor head pressure requisite for total system operation, as taught by U.S. Pat. No. 3,358,469. Such subcooling can result in substantial energy or power savings unless it has to be obtained by offsetting power usage through the use of conventional mechanical subcooler units in the liquid line to the expansion valves to prevent, flash gas due to liquid line pressure reduction during gas defrosting, as taught by U.S. Pat. No. 3,150,490. Thus, the advantages of liquid refrigerant subcooling in efficient operation of system compressors and evaporators and the potential power savings thereby achieved are well known. However, heretofore the installation of conventional mechanical subcoolers for use during summer operations has remained the primary solution to efficient system refrigeration during hot weather.

The use of heat reclamation is also well understood and can result in substantial energy or power savings during winter and intermediate seasons depending upon the relative costs of electrical compressor power and heating fuel. If the compressor head pressure is increased there will be a higher heat reclamation potential, but at a higher power consumption by the compressors, as discussed in U.S. Pat. No. 4,522,037.

SUMMARY OF THE INVENTION

The invention is embodied in a refrigeration system having a heat reclaim coil with first valve means selectively connecting the coil between the compressor and condenser means in a heat reclamation mode during winter operation, and second valve means selectively connecting the coil between the condenser means and a system receiver in a subcooling mode during summer operation. The invention further includes the method of effecting reverse cycle operation of the heat reclaim coil in its seasonal heat reclamation and subcooling modes.

The principal object of the present invention is to provide a refrigeration system that will maintain year-round deep subcooling of liquid refrigerant without the use of mechanical subcoolers.

Another object is to provide more efficient air conditioning reheat for humidity control during summer operation.

Another object is to employ a heat reclaim coil in a reverse cycle subcooling and sensible reheat mode for beneficial air conditioning comfort and improved refrigeration performance.

Still another object is to provide a compensation factor in the refrigerant overcharge typically associated with low head pressure operation of compressors and volumetric expansion during warmer seasonal operation.

These and other objects and advantages will become more apparent hereinafter.

DESCRIPTION OF THE DRAWINGS

In the drawings which illustrate embodiments of the invention.

DESCRIPTION OF THE PREFERRED EMBODIMENT

For disclosure purposes a closed refrigeration system embodying the invention is illustrated as being of the commercial multiplexed type having dual or twin parallel compressors as installed in a supermarket food store for operating a plurality of separate fixtures, such as refrigerated storage and display cases, but it will be understood by those skilled in the art that such a system may be adapted to other commercial or industrial installations. The term "high side" is used herein in a conventional refrigeration sense to mean the portion of the system from the compressor discharge to the evaporator expansion valves and the term "low side" means the portion of the system from the expansion valves to the compressor suction.

Figure 1:
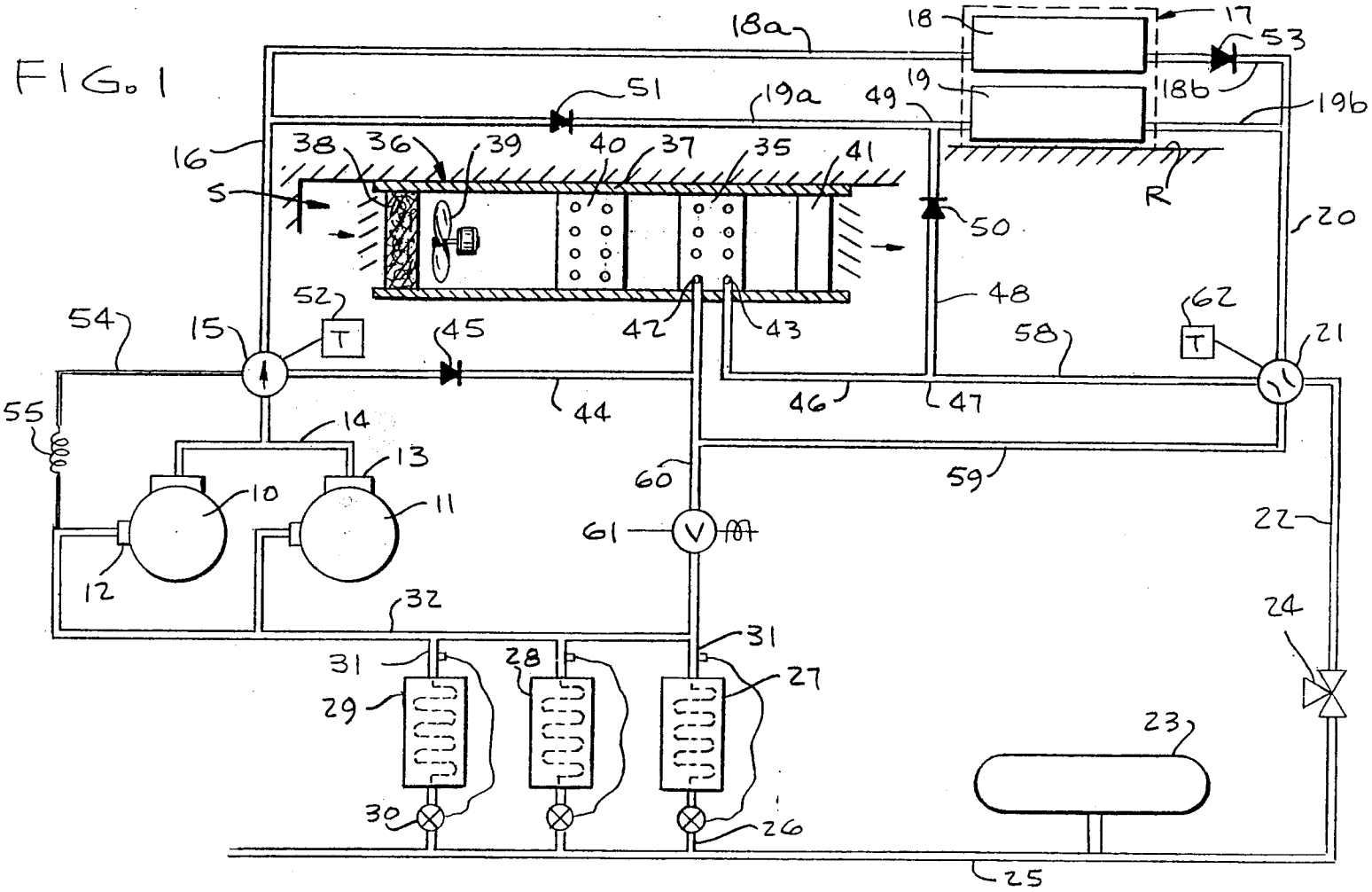
FIG. 1 is a diagrammatic view of a typical refrigeration system embodying the invention, and illustrating a moderate season operational mode.

Referring to FIG. 1, the refrigeration system includes a pair of compressors 10 and 11 connected in parallel and each having a suction or low pressure side 12 operating at a predetermined suction pressure and a discharge or high pressure side 13 connected to a common discharge header 14 through which hot compressed gaseous refrigerant is discharged for condensing. The discharge header 14 is connected through a reversing valve 15 in discharge line 16 to a condenser 17 having split coil sections 18 and 19 and conventionally being mounted outside on the roof R of the building. The condenser coil section 18 is connected to the compressor discharge line 16 by an inlet branch line **18*a* and to a refrigerant outflow conduit 20 by a branch outlet line 18*b*. The condenser coil section 19 is connected to the discharge line 16 by a branch inlet line 19*a* and to the outlet conduit 20 by branch outlet line 19*b*. The refrigerant is reduced to its condensing temperature and pressure by ambient air flow through the condenser 17, and the outlet conduit 20 is connected through a four-way reversing valve 21 and condensate line 22 to a receiver 23 forming a liquid refrigerant source for operating the system. A flooding valve 24 may be provided in the conduit 22 in a typical manner to produce variable condenser flooding and maintain compressor head pressures at or above a preselected minimum as during winter or cold weather operation. The receiver 23 may be of the surge-type or flow-through and is connected to a liquid header 25 for conducting liquid refrigerant to branch liquid lines or conduits 26 leading to evaporator coils 27, 28 and 29 associated with different refrigerated fixtures (not shown) and being representative of numerous evaporators that may be connected into the refrigerant system. The inlet of each evaporator 27, 28 and 29 is controlled by an expansion valve 30 which meters refrigerant into the evaporators in a conventional manner. The outlets of the evaporators are connected through branch suction lines or conduits 31 to a suction header 32 connected to the suction side 12 of the compressors 10 and 11** and through which vaporous refrigerant from the evaporators is returned to the compressors to complete the basic refrigeration cycle. The fixture evaporators may be selectively defrosted as periodically required in a typical way, as by electric or hot gas defrost. The construction and operation of the system so far described will be more fully understood by reference to U.S. Pat. Nos. 3,427,819 and 4,522,037.

The invention is embodied in a heat reclaim coil 35 that is selectively connected into the refrigeration system to function in reverse cycle in a winter heat reclamation mode and a summer subcooling and reheat mode. The heat reclaim coil 35 is located in an air handler unit 36 positioned in air flow communication with a building room or store space S to be heated or cooled. Such an air handler unit 36 is disclosed in U.S. Pat. No. 4,502,292 and, for purposes of the present invention, includes a ducted airway 37 having an air inlet and sequentially arranged components including an air filter 38, a push-through fan or blower 39, an air conditioning coil 40 that is part of a separate air conditioning system or heat pump (not shown), the heat reclaim coil 35 and a supplemental space air heater 41.

Figure 3:
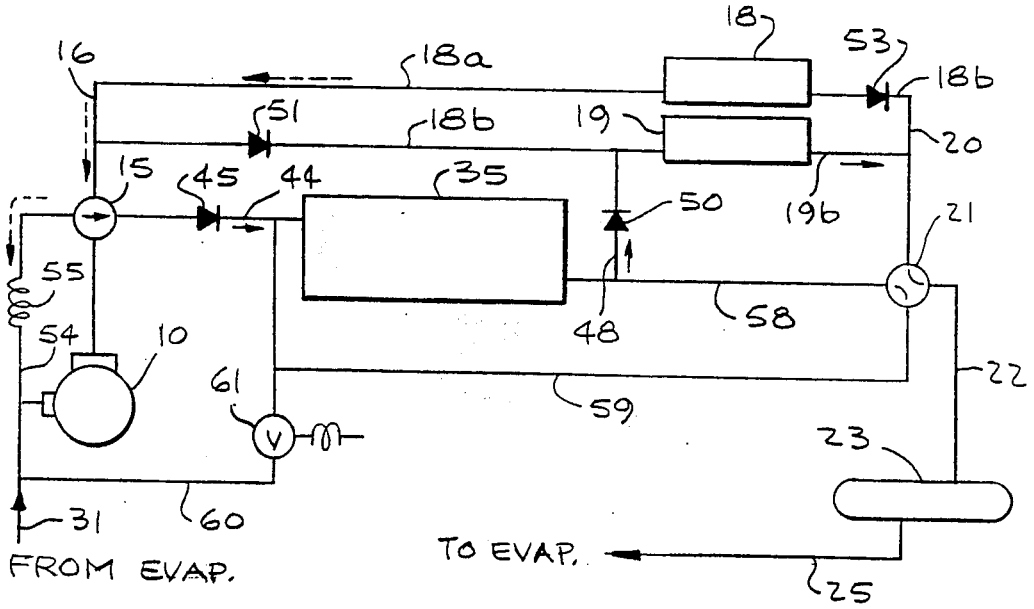
FIG. 3 is a diagrammatic view illustrating a winter operational mode of the invention.

Referring to FIGS. 1 and 3, the heat reclaim coil 35 has piping connections 42 and 43 on opposite sides thereof, the first piping connection 42 being connected by conduit 44 to the reversing valve 15. A one-way check valve 45 is provided in conduit 44 to permit refrigerant flow only from the valve 15 to the heat reclaim coil 35. The second piping connection 43 is connected to a conduit 46, which connects at a tee 47 to another conduit 48 in turn connected into branch inlet line **19*a* at another tee 49 leading to one of the condenser coil sections 19. A one-way check valve 50 is provided in conduit 48 to limit refrigerant flow therein only in the direction of the condenser section 19 and prevent reverse flow. A one-way check valve 51 is also provided in branch conduit 19*a* upstream of the tee connection 49 to limit refrigerant flow in conduit 19*a* only in the direction of the condenser section 19. Thus, during winter operation when store heat is required in the space S, the valve 15 will be operated by a store thermostat 52 sensing the temperature of the room air to connect the discharge header 14 to the conduit 44 so hot compressed refrigerant will be circulated through the heat reclaim coil 35 to heat room supply air recirculated through the air handler 36 by fan 39. The temperature of the refrigerant is reduced to a point just above saturation and the refrigerant then flows through conduits 46, 48 and 19*a* to the condenser section 19 in which the refrigerant is fully condensed and deep subcooling is inherently achieved in winter operation. Subcooled refrigerant condensate flows from the condenser section 19 through conduits 19*b* and 20 to the second reversing valve 21, which connects to condensate line 22 and the receiver 23 during winter and moderate weather operations. The outlet branch conduit 18*b* from the condenser section 18 has a one-way check valve 53 to prevent backflow of condensed refrigerant into this section during winter operations. The one-way check valves 45, 51 and 53 may be of well-known conventional construction, either a swing check element (not shown) normally closing by gravity or a spring-loaded element (not shown) normally closed under spring pressure of negligible force, which open under refrigerant flow pressure in one direction only. The check valve 50 is preferably of the spring-loaded type having a force of about 2–5 psi, and which is normally kept closed in summer operation by the additional force of the high side pressure drop in the magnitude of 2–10 psi across the condenser section 19. The check valve 50 is capable of opening in summer operation under unusual refrigerant surge conditions in cycling compressors or the like to relieve any refrigerant hydrostatic condition developing within the coil 35** and provide pressure equalization to prevent hammering.

It is clear that the refrigerant condensation is easily achieved with smaller condenser surface in cold weather, and that the coil section 18 may be isolated from the refrigeration circuit at such time to reduce condensing capacity. The flooding valve 24 may be required in extreme cold weather to back-flood the condenser section 19 and effectively reduce its condensing capacity in order to maintain minimum compressor head pressure. The reversing valve 15 is ported to connect the line 16 to a bleeder line 54 during the heat reclaim mode when the compressor discharge is diverted to the heat reclaim coil 35. The bleeder line 54 is connected to the suction side 12 of one of the compressors (10, 11) or to the suction header 32 thereto, and a capillary tube 55 is provided to assure that the refrigerant bled down from condenser section 18 through line 16 will undergo a change of phase to vapor when going to the compressor suction. Thus, any residual refrigerant is bled off from coil section 18 thereby reducing the refrigerant overcharge normally required in the system for full seasonal operations, as will be discussed more fully.

Figure 2:
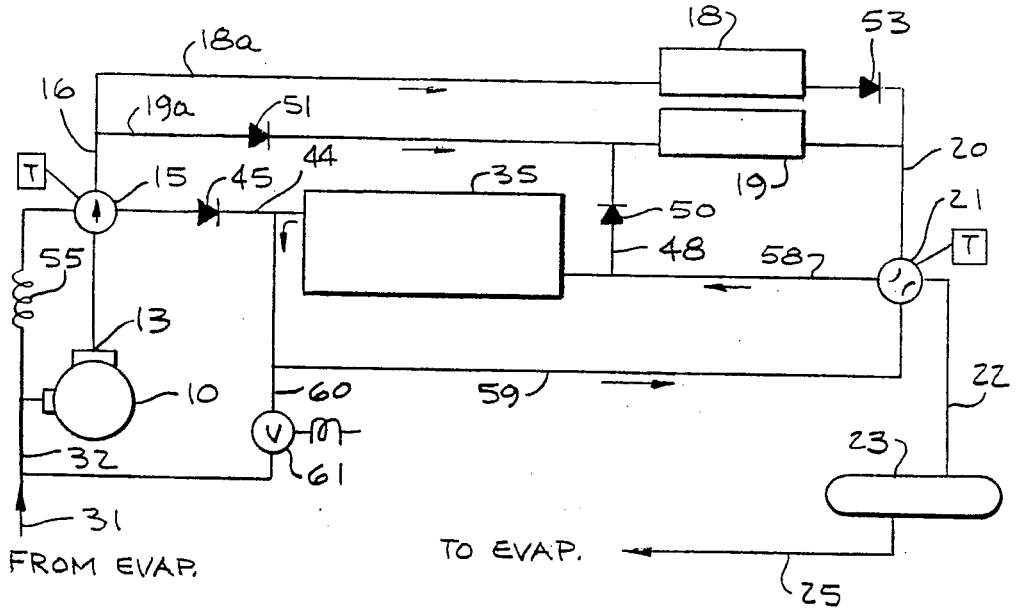
FIG. 2 is a diagrammatic view illustrating a summer operational mode of the invention.

Referring to FIGS. 1 and 2, the heat reclaim coil 35 is reversely connected in the system for summer operations. A conduit 58 connects the tee 47 (conduits 46, 48) with another port of the reversing valve 21 to provide an open piping connection to one side of the heat reclaim coil 35, and the other side of this coil 35 has another conduit 59 extending between the conduit 44 on the downstream side of check valve 45 and a fourth port in the reversing valve 21. FIG. 1 illustrates the valve 21 in position for normal moderate weather operation in which the condensate outflow from the condenser 17 through conduit 20 is diverted directly into the line 22 and receiver 23. In the summer mode shown in FIG. 2, the reversing valve 21 is turned to divert condensate outflow from the conduit 20 into the conduit 58 in a reverse flow path through the heat reclaim coil 35 and back through conduits 44, 59 to the reversing valve 21 and thence to condensate line 22 and the receiver 23. Another conduit 60 is provided between the heat reclaim coil 35 and the suction header 32 to provide bleed-down of residual refrigerant from the heat reclaim coil 35 during inoperative (moderate weather) periods. The conduit 60 is shown connected to conduit 59 and is controlled by a normally closed solenoid valve 61, although the conduit 60 may be connected at any place that will provide gravity refrigerant flow to the suction side 12 of the compressor means 10, 11. It should again be noted that the heat reclaim coil 35 does not fully reduce refrigerant to saturation so such refrigerant will be essentially in a vapor phase for re-entry into the suction header 32 and return to the compressors without slugging.

In the operation of the refrigeration system during moderate climatic weather conditions as in the spring and fall, the discharge line valve 15 will connect the compressor header 15 through conduit 16 to both outside condenser sections 18 and 19, and the reversing valve 21 will connect the outflow conduit 20 directly to condensate line 22 to the receiver 23. In this intermediate seasonal mode the heat reclaim coil 35 is isolated from the refrigeration circuit by the reversing valves 15 and 21 and the check valve 50, and the solenoid valve 61 is opened to permit refrigerant pump out from the heat reclaim coil 35 to suction through conduit 60. Condensing capacity of the condenser sections 18 and 19 is conventionally controlled by cycling zone condenser fans (not shown) or the like to remove superheat and reduce the refrigerant to a subcooled liquid phase.

During cold weather operation (FIG. 3) when the store space S requires heat, the thermostat 52 will switch the reversing valve 15 to connect the compressor discharge header 14 into line 44 to the heat reclaim coil 35 thereby disconnecting the discharge conduit 16 leading to condenser branch conduits 18*a* and 19*a*. Air circulation through the air handler 36 will effect heat exchange in the heat reclaim coil 35 in a normal manner whereby superheated refrigerant energy (upwards of 75%) is transferred to the recirculated store air and the refrigerant is thus cooled toward its saturation level. The refrigerant then flows out through conduits 46 and 48 through check valve 50 into one condenser section 19 to complete final condensation to a subcooled liquid phase, and the refrigerant condensate then flows through conduit 20, valve 21 and conduit 22 to the receiver 23. The outside condenser 17 effects refrigerant cooling or condensation by ambient air flow therethrough and is sized according to design entering air temperatures and heat rejection loads to meet summer requirements. Thus, the condensing capacity of the outside condenser 17 greatly exceeds the winter requirements, and the split condenser 18, 19 permits one-half of the outside condenser to be disconnected from the refrigeration circuit. Deep refrigerant subcooling can be inherently achieved during winter and moderate weather conditions by controlling condenser capacity, and the primary objective is to provide efficient refrigeration operation by maintaining a minimum compressor head pressure as by throttling the flooding valve 24 to backflood the condenser section 19 and reduce its effective heat exchange surface.

The method of operation in summer weather achieves the potential of the present invention in which the reverse operating refrigerant flow mode through the heat reclaim coil 35 effects deep subcooling and air conditioning humidity control through reheat. In the summer subcooling mode (FIG. 2), the reversing valve 15 is positioned to deliver the compressor discharge through conduit 16 to both condenser sections 18 and 19 for maximum outdoor condensing capacity to meet design entering air temperatures and heat rejection loads. The reversing valve 21 is operated in response to a second thermostatic control 62 responsive to the temperature of the building space S to connect the condensate line 20 to conduits 58, 46 and circulate refrigerant condensate in reverse cycle through the heat reclaim coil 35 and back through conduit 59 to connect through the valve 21 to condensate line 22 to the receiver 23. The reversing valve 21 is preferably a slow-acting valve to permit the refrigerant condensate outflow in conduit 20 to be directed into line 58 to the coil 35 without creating a hydrostatic surge condition that might otherwise produce a hammering effect due to change of refrigerant phase in the downstream lines. Although the typical outside condenser 17 is sized to meet the normal summer refrigeration requirements of the system evaporators 27, 28 and 29, there is little subcooling effect, if any, in the refrigerant condensate in liquid line 25 in a conventional refrigeration system. However, in the present invention the heat reclaim coil 35 is located in downstream air flow of the air conditioning coil 38 in the air handler unit 36 so that the flow of cold supply air from the coil 38 passes through the heat reclaim coil 35 in heat exchange relation with the refrigerant condensate therein. The attributes of the reverse cycle refrigerant flow through the coil 35 and conditioned air heat exchange therewith are that (1) the cold conditioned air temperature is warmed or "reheated" a few degrees to a warmer temperature so that the space supply air is not at or near saturation and store air dehumidification as well as cooling is enhanced, and (2) the condensed liquid refrigerant in the heat exchange coil 35 is substantially subcooled to improve the performance of evaporators 27–29. In short, the reverse cycle summer mode of the heat reclaim coil 35 produces both air conditioning reheat and deep refrigerant subcooling without the use of separate reheat or mechanical subcooler devices presently being employed, and such subcooling results in substantial compressor energy requirements and power savings.

In summer operation there are two operational factors that must be balanced. One basic factor is to provide efficient refrigeration operation, particularly in the maintenance of proper temperatures in food store display merchandisers and storage cases for consumer fresh and frozen food products and it is desirable to keep the store space relative humidity (RH) down so that the fixture evaporators 27–29 can operate for longer periods with a minimum of icing. The second factor, particularly important in food store merchandising in today's society, is to keep the store space S at a cool temperature for the comfort of the customers and thus proper air conditioning achieves an optimum temperature/humidity comfort zone in the store space S. In the operation of the refrigeration system of the present invention, the comfort zone is considered to be an overriding factor in view of the fact that the refrigeration system components are sized to meet proper design refrigeration requirements even without reverse cycle summer deep subcooling. Therefore, the second thermostatic control 62 continually operates the heat reclaim coil 35 in its reverse cycle subcooling and reheat mode during the summer at all times the air conditioning system (40) is operational except when the comfort zone of the space S exceeds a predetermined value, such as a temperature of 75° F. and 50% RH or 79° F. and 25% RH. If the store space temperature is sensed to be above such a value, then the reversing valve 21 is switched to disconnect the heat reclaim coil 35 and discontinue subcooling in order to achieve maximum air conditioning temperatures (even at the expense of higher relative humidity levels) until the store zone S is brought back to a preselected comfort zone temperature at which time the subcooling refrigerant circuit is reestablished.

The present invention is also beneficial in reducing the amount of refrigerant overcharge required for year-round refrigeration system operations. The state of the refrigerant varies substantially between summer and winter operation in a conventional refrigeration system. In the summer, the volume of refrigerant is substantially greater due to the typically higher refrigerant temperatures created by higher compressor head pressures and refrigerant condensation that only meets design requirements with the result that the receiver 23 is typically filled with excess refrigerant. This overcharge is required, however, during winter operation in which a denser subcooled refrigerant state is naturally achieved. In the present invention, this refrigerant design overcharge, which may range to about 250 pounds or 30%, can be substantially reduced by as much as 40% due to the split (one-half) outside condenser reduction and bleed down in the winter mode, and the use of the heat reclaim coil 35 producing deep subcooling and a solid liquid phase in the summer mode may produce an additional 10% reduction in the overcharge requirement thereby effecting substantial savings in refrigerant costs.

From the foregoing, it will be understood that the objects and advantages of the present invention are fully met. It will also be understood that the terms "winter" and "summer" with reference to ambient temperature or climatic weather conditions are not seasonally limited, but are used more broadly to reference time periods in which the refrigeration system operates in different modes as store space heating and cooling are required. Those skilled in the art will understand the use of ambient compensated controllers and other temperature/humidity sensing devices that can be substituted for the thermostats 52 and 62 to control the reversing operations of valves 15 and 21. The invention covers changes and modifications in the disclosure as will be readily apparent to those skilled in the art, and the invention is only limited by the appended claims.

What is claimed is:

1. A reverse cycle heat reclaiming and subcooling system in combination with a refrigeration system having compressor means with discharge and suction sides, and condenser, receiver and evaporator means; said heat reclaiming and subcooling system comprising a heat reclaim and subcooling coil, first means for selectively connecting said coil in series refrigerant flow between said compressor means discharge side and said condenser means for heat reclamation in a winter refrigeration mode of said refrigeration system, and second means for connecting said coil in series refrigerant flow between said condenser and receiver means for subcooling refrigerant condensate in a summer refrigeration mode.

2. The heat reclaiming and subcooling system according to claim 1, in which said second means comprises a reversing valve connected to the refrigerant outflow side of said condenser means and having a first position connecting the condenser outflow side to said coil in said summer refrigeration mode for subcooling refrigerant condensate, said reversing valve having a second position connecting the outflow side of said condenser means to said receiver means in said winter refrigeration mode and in a third refrigeration mode during moderate climatic conditions.

3. The heat reclaiming and subcooling system according to claim 1, in which said first means comprises a first reversing valve on the discharge side of said compressor means and said second means comprises a second reversing valve on the refrigerant outflow side of said condenser means, said first reversing valve having a first position connecting said coil between said compressor discharge side and said condenser means in said winter refrigeration mode and a second position connecting said compressor discharge side to said condenser means in by-pass relation to said coil in said summer refrigeration mode and in a third refrigeration mode during moderate climatic conditions, said second reversing valve having a first position connecting the refrigerant outflow side of said condenser means in series flow relation to said coil in said summer refrigeration mode and a second position connecting the condenser outflow side to said receiver means in said winter and third refrigeration modes.

4. The heat reclaiming and subcooling system according to claim 3, which includes a first conduit having check valve means connecting said first reversing valve to said coil in unidirectional flow in the first position of said first reversing valve, and a second conduit having second check valve means connecting said coil in unidirectional flow to said condenser means.

5. The heat reclaiming and subcooling system according to claim 3, including sensing means for operating said first and second reversing valves in response to climatic temperature conditions.

6. The heat reclaiming and subcooling system according to claim 5, which includes an air handler unit for seasonally conditioning space air in a building, said coil being positioned in said air handler unit and heating space air circulated therethrough in the winter refrigeration mode.

7. The heat reclaiming and subcooling system according to claim 6, in which said air handler unit includes an air conditioning coil for cooling space air during the summer refrigeration mode, said coil being located downstream of said air conditioning coil and being operative to reheat cooled space air and produce subcooling of refrigerant condensate in the summer refrigeration mode.

8. The heat reclaiming and subcooling system according to claim 7, in which said sensing means includes means for sensing the temperature/humidity comfort zone of the space air in the building and disconnecting said coil from its subcooling and reheat operation during the summer refrigeration mode when the sensed comfort zone exceeds a predetermined value.

9. The heat reclaiming and subcooling system according to claim 3, in which said coil is isolated from its high side connections to said refrigeration system in the second position of said first and second reversing valves, and means for connecting said coil to the suction side of said compressor means to provide refrigerant pump down from said coil.

10. The heat reclaiming and subcooling system according to claim 9, in which said last means comprise a conduit having normally closed valve means adapted to be opened when said first and second reversing valves are in their second position.

11. The heat reclaiming and subcooling system according to claim 3, in which said condenser means comprises a split condenser having first and second condenser sections, said first reversing valve disconnecting said condenser sections from said compressor discharge side in the first position thereof, and means for providing bleed down of residual refrigerant from said first condenser section when said first reversing valve is in its first position.

12. The heat reclaiming and subcooling system according to claim 11, in which said bleed down means comprises a conduit connection from said one condenser section through said first reversing valve to the suction side of said compressor means.

13. The heat reclaiming and subcooling system according to claim 12, in which said bleed down means further comprises refrigerant expansion means for returning only refrigerant vapor through said conduit connection to said compressor suction side.

14. The heat reclaiming and subcooling system according to claim 13, in which said expansion means is a capillary tube.

15. The heat reclaiming and subcooling system according to claim 11, in which said coil is connected in series flow relation to said second condenser section in the winter refrigeration mode, and check valve means upstream of said series flow connection preventing refrigerant flow from said coil in a direction away from said second condenser section.

16. The heat reclaiming and subcooling system according to claim 15, including other check valve means on the refrigerant outflow side of said first condenser section to prevent back flow of refrigerant condensate therethrough from said second condenser section.

17. The heat reclaiming and subcooling system according to claim 1, which includes an air handler unit adapted to seasonally condition space air in a building, a separte air conditioning system having an air conditioning coil positioned in said air handler unit and being operational for cooling space air during the summer refrigeration mode of said refrigeration system, said heat reclaim and subcooling coil being positioned in said air handler unit in downstream air flow relation from said air conditioning coil and being in heat exchange with the cooled space air to provide reheat of such space air and produce subcooling of refrigerant condensate in said refrigeration system during the summer refrigeration mode thereof, and said heat reclaim and subcooling coil heating said space air in the winter refrigeration mode of said refrigeration system when said air conditioning system in inoperative.

18. In combination with a refrigeration system including compressor means having discharge and suction sides, condenser means, receiver means and multiple evaporator means, a heat reclaim coil disposed in an air handler unit adapted to seasonally condition air for heating and cooling space air in a building, said heat reclaim coil having first and second piping connections and being selectively connected in said refrigeration system for reverse cycle operation between a heating mode and a subcooling mode, a first reversing valve located on the discharge side of said compressor means and having a summer position connecting said discharge side to said condenser means and a winter position for connecting said discharge side to said first piping connection of said heat reclaim coil, a second reversing valve located upstream of said receiver means and having a summer position and a winter position, said second reversing valve connecting said condenser means to the second piping connection of said heat reclaim coil and the first piping connection of said heat reclaim coil to said receiver means in the summer position thereof, and said second reversing valve connecting said condenser means to said receiver means in the winter position thereof.

19. The method of producing all-season subcooling in a refrigerantion system having compressor means with a discharge high side and a suction low side, condenser means, a heat reclaim coil, receiver means and evaporator means, comprising the steps of sequentially connecting the condenser, receiver and evaporator means between the discharge and suction sides of said compressor means in a normal refrigeration mode during moderate climatic conditions, sequentially connecting the heat reclaim coil and the condenser, receiver and evaporator means between the discharge and suction sides of said compressor means in a second refrigeration mode during winter climatic conditions, sequentially connecting the condenser means, heat reclaim coil and said receiver and evaporator means between the discharge and suction sides of said compressor means in a third refrigeration mode during summer climatic conditions, and selectively operating separate air cooling means positioned in upstream air flow relation from said heat reclaim coil in the third refrigeration mode thereof.

20. The method according to claim 19, including disconnecting the heat reclaim coil from refrigerant flow communication with the discharge high side in the normal refrigeration mode, and connecting the heat reclaim coil to the suction low side to provide refrigerant pump-down from the heat reclaim coil.

21. The method according to claim 19 in which said refrigeration system includes a refrigerant outflow conduit from said condenser means and a four-way reversing valve positioned in said outflow conduit, and operating said reversing valve in the third refrigeration mode to divert regrigerant outflow in a subcooling circuit from said condenser means through said heat reclaim coil and back through said reversing valve for delivering subcooled refrigerant to the receiver means.

* * * * *